US009697719B2

(12) United States Patent
Trumphy

(10) Patent No.: US 9,697,719 B2
(45) Date of Patent: Jul. 4, 2017

(54) SECURITY SYSTEM, SECURITY ARRANGEMENT AND METHOD THERFORE

(71) Applicant: Trumphy Ltd., Solna (SE)

(72) Inventor: Jonas Patrik Trumphy, Solna (SE)

(73) Assignee: TRUMPHY LTD., Solna (SE)

( * ) Notice: Subject to any disclaimer, the term of this patent is extended or adjusted under 35 U.S.C. 154(b) by 60 days.

(21) Appl. No.: 14/919,489

(22) Filed: Oct. 21, 2015

(65) Prior Publication Data

US 2016/0117914 A1 Apr. 28, 2016

(30) Foreign Application Priority Data

Oct. 22, 2014 (SE) ..... 1451261-0

(51) Int. Cl.
*G08B 1/08* (2006.01)
*G08B 25/01* (2006.01)
*G08B 25/00* (2006.01)

(52) U.S. Cl.
CPC ..... *G08B 25/016* (2013.01); *G08B 25/009* (2013.01)

(58) Field of Classification Search
CPC G08B 21/02; G08B 21/0446; G08B 21/0453; G08B 25/016; G08B 21/18; G08B 25/10; G08B 5/22; G08B 6/00; G08B 25/009
See application file for complete search history.

(56) References Cited

U.S. PATENT DOCUMENTS 6,607,484 B2 * 8/2003 Suzuki ..... A61B 5/0002 128/903
8,441,356 B1 * 5/2013 Tedesco ..... G08B 21/0453 340/539.15
2003/0027547 A1 * 2/2003 Wade ..... G08B 25/016 455/404.1
2004/0212505 A1 * 10/2004 Dewing ..... A61B 5/0002 340/573.1
2009/0088207 A1 * 4/2009 Sweeney ..... H04M 19/04 455/557

* cited by examiner

*Primary Examiner* — Omeed Alizada
(74) *Attorney, Agent, or Firm* — Perkins Coie LLP

(57) ABSTRACT

The present invention relates to a security system for personal protection, having a first unit and a second unit separate from the first unit, wherein the first unit has a camera device, a microphone device, a siren device, a safety device, an attachment device, and a communication device for communication wirelessly with the second unit. The second unit has a microphone device and a communication device for communication wirelessly with the first unit. The second unit further has a communication device for wirelessly sending an alarm message to a network of one or more recipients. The security system is configured to, when triggered to send an alarm message, activate the microphone device of the first unit and the microphone device of the second unit, such that the alarm message contains an audio recording from an environment of a user of the security system. A method and a security arrangement therefore are also presented.

10 Claims, 2 Drawing Sheets

SECURITY SYSTEM, SECURITY ARRANGEMENT AND METHOD THERFORE

TECHNICAL FIELD

The present invention relates to a security system for personal use.

BACKGROUND

Many people are today worried for their personal security when they are outside their home.

Known solutions for personal security are e.g. presented in US 2009/0315703, GB 2 423 611, GB 2 394 863 and GB 2 429 091.

SUMMARY

In order for a personal security system to be readily available for a lot of people, the system needs to be both cost effective in production and easy and secure to use.

On object of the present invention is to provide a cost effective and easy and secure to use security system.

This object is according to the present invention attained by a security system, a security arrangement and a method therefor, respectively, as defined by the appended claims.

A security system for personal protection, comprising a first unit and a second unit separate from the first unit is presented. The first unit comprises a camera device, a microphone device, a siren device, a safety device, an attachment device, and a communication device for communication wirelessly with the second unit. The second unit comprises a microphone device and a communication device for communication wirelessly with the first unit. The second unit further comprises a communication device for wirelessly sending an alarm message to a network of one or more recipients. The security system is configured to, when triggered to send an alarm message, activate the microphone device of the first unit and the microphone device of the second unit, such that the alarm message contains an audio recording from an environment of a user of the security system. The second unit may be implemented by a portable radio communication device, such as a smart phone, and the first unit does not need separate network communication capabilities. The security system built in back-up capability by both units having a microphone device, ensuring that even if the first unit is manipulated, the second unit can still send an alarm message with recorded sound.

The first unit may during use be attached to a user through the attachment device, and the second unit may during use be carried by that user.

The second unit may be a portable radio communication device and the first unit may be an auxiliary device to the portable radio communication device.

The first unit may further comprise a positioning device and/or a warning light, and the second unit may further comprise a positioning device. With the use of a positioning device, such as GPS, tracking of the user is facilitated, and with the use of a warning light on the first unit a person can easily detect that the user is protected by a personal security system. The security system may be activated/deactivated through a user-verification on the second unit. In this way the security system is not easily deactivated by someone manipulating/destroying the first unit.

The security system may comprise a third unit, separate from the first unit and separate from the second unit. The third unit comprising a positioning device and a communication device, wherein the third unit is configured to activate the positioning device and send a geographical position to the network after activation from the first and/or the second unit.

A security system for personal protection, comprising a first unit and a second unit separate from the first unit is also presented. The first unit comprises attachment means for attachment of the first unit on a user during use of the security system, registration means for registration of surroundings of the user, alarm means for sounding a siren, and communication means for communication wirelessly with the second unit. The second unit comprises registration means for registration of surroundings of the user and communication means for communication wirelessly with the first unit. The second unit further comprises communication means for wirelessly sending alarm messages to a network of one or more recipients. The communication means of the second unit is configured to send an alarm message to the network when one or more of the following occurs: the first or second unit is manipulated, when a voice command is registered through the registration means of the first unit or of the second unit, and when an actuator is triggered.

A method for personal protection is further presented. The method comprises the steps: detecting manipulation in a first unit wirelessly connected to a second unit, or detecting a voice command in the first unit and/or in the second unit; recording video and audio in the first unit and audio in the second unit; producing an alarm signal in the first unit; and sending a message to a network of one or more recipients from the second unit.

The method may further comprise the step of producing an alarm signal in the second unit. This provides a backup also for the alarm signal.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated.

BRIEF DESCRIPTION OF THE DRAWINGS

The invention is now described, by way of example, with reference to the accompanying drawings, in which.

DETAILED DESCRIPTION

The invention will now be described more fully hereinafter with reference to the accompanying drawings, in which certain embodiments of the invention are shown. This invention may, however, be embodied in many different forms and should not be construed as limited to the embodiments set forth herein; rather, these embodiments are provided by way of example so that this disclosure will be thorough and complete, and will fully convey the scope of the invention to those skilled in the art. Like numbers refer to like elements throughout the description.

Figure 1:
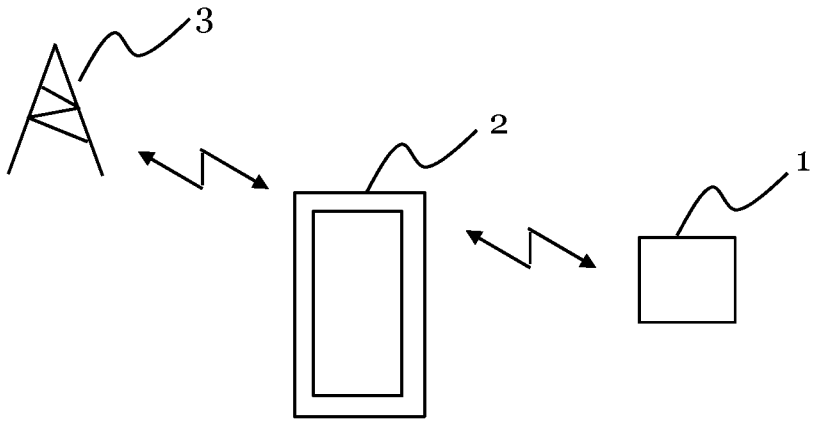
FIG. 1 schematically illustrates an environment where embodiments presented herein can be applied.

A security system according to an embodiment of the present invention will now be described with reference to FIG. 1.

The security system for personal protection comprises a first unit 1 and a second unit 2 separate from the first unit 1. The first unit 1 comprises a camera device, a microphone device, a siren device, a safety device, an attachment device, and a communication device for communication wirelessly with the second unit 2. The second unit 2 comprises a microphone device and a communication device for communication wirelessly with the first unit 1, the second unit further comprises a communication device for wirelessly sending an alarm message to a network of one or more recipients. The safety device may be integrated in the attachment device. When an alarm is triggered, the security system activates both the microphone device of the first unit 1 as well as the microphone device of the second unit 2, such that the alarm message contains an audio recording from an environment of a user of the security system. In this way, even if e.g. the first unit 1 is manipulated or destroyed, an audio recording is sent together with the alarm message.

The first unit 1 thus comprises attachment means for attachment of the first unit 1 on a user during use of the security system, registration means for registration of surroundings of the user, alarm means for sounding a siren, and communication means for communication wirelessly with the second unit 2.

The second unit 2 thus comprises registration means for registration of surroundings of the user and communication means for communication wirelessly with the first unit 1, the second unit further comprises communication means for wirelessly sending alarm messages to a network. The communication means of the second unit 2 is configured to send an alarm message to the network when triggered e.g. by the first or the second unit being manipulated, and/or when a voice command is registered through the registration means of the first unit or of the second unit, and/or when an actuator of the safety device is triggered. The second unit 2 may communicate wirelessly with a base station 3 of e.g. a cellular network, to access the network of recipients. The network of recipients may comprise personal connections or a general emergency central, such as 112 within the EU. An alarm message may be sent to one or multiple recipients of the network.

The first unit 1 is during use preferably attached to a user through the attachment device, and the second unit 2 is during use preferably carried by that user. The second unit is preferably a portable radio communication device, such as a mobile phone, smart phone or similar device, and the first unit is preferably an auxiliary device to the portable radio communication device. The auxiliary device may be sold separately from the portable radio communication device and configured to communicate wirelessly to a smart phone.

The first unit 1 preferably further comprises a positioning device and, and the second unit may further comprises a positioning device, the positioning devices providing geographical positions. With the provision of a positioning device, such as a GPS receiver, in the first unit, an alarm message provided with a geographical position sent to the network can instantly identify where a person is. By having a positioning device in the second unit the same advantage is achieved. By having a positioning device in both units, also a backup is achieved in case the first unit is manipulated or destroyed.

The first unit 1 preferably further comprises a warning light, which is arranged to visually indicate when the security system is activated. A possible attacker will in this way be deterred from attacking the user of the security system.

The security system may be activated/deactivated through a user-verification on the second unit. When the security system is activated an alarm message is sent when triggered. Recordings of the surroundings may, when the security system is activated, continuously record audio of the surroundings of the user, but only save e.g. the last couple of seconds or minutes to be send upon triggering of an alarm.

For triggering the alarm of the security system, a voice command may be given, which may be received by the first and/or the second unit and processed, preferably in the second unit. Alternatively, or additionally, the security system may be triggered by the safety device. The safety device may comprise a proximity sensor, for detecting the distance to the second unit, a switch sensor for detecting when the attachment device is being opened, an accelerometer detecting sudden movements of the first unit, and/or a contact sensor for detecting removal from the user. The proximity sensor is preferably triggered when the distance between the first and second unit is over e.g. two meter. The shorter trigger distance that is selected, the higher risk for falsely triggering of alarm, and the higher distance selected the higher risk for no triggering of alarm in an actual unsafe situation. Detection of opening of the attachment device may be arranged through magnetic contacts, micro switches or similar devices.

Placement of the first unit is preferably high and visible on the user, such as in the form of earpiece, necklace, ring, bracelet, glasses, or clothes in the form of a hat or a shoulder piece.

Further, the security system may comprise a third unit, separate from the first and second units. The third unit may comprise a chip with a positioning device and a communication device, hidden on the user. The third unit may even be implanted under the skin of the user. The third unit is preferably only activated by the first or the second unit upon activation of an alarm. By only being activated upon activation of alarm energy is saved, and the third unit may e.g. intermittently transmit a geographical position of the user to the network of recipients to further save energy.

Figure 2:
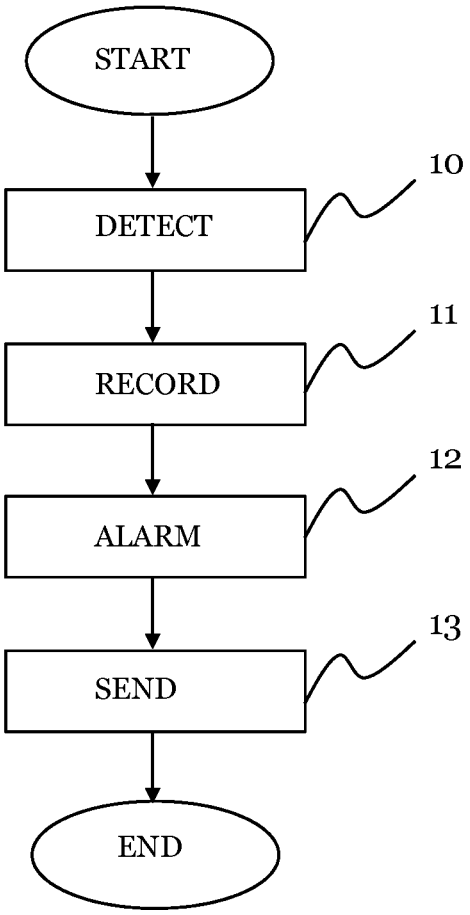
FIG. 2 is a flowchart according illustrating a method for an embodiment presented herein.

A method for personal protection is presented with reference to FIG. 2, comprising the steps in the following order:

- recording audio in a first unit 1 and in a second unit 2 separate from the first unit 1,
- detecting 10 manipulation in the first unit 1 wirelessly connected to the second unit 2, or detecting 10 a voice command in the first unit 1 and/or in the second unit 2;
- recording 11 video and audio in the first unit 1 and audio in the second unit 2;
- producing 12 an alarm signal in the first unit 1; and
- sending 13 a message to a network from the second unit 2. The message includes an audio recording from the first and/or the second unit.

The method may further comprise the step of producing an alarm signal in the second unit 2.

A security arrangement 1 for personal protection is also presented, comprising a camera device, a microphone device, a siren device, a safety device, an attachment device, and a communication device for communication wirelessly with a portable radio communication device 2.

The camera device and the microphone device are configured to register data of surroundings of a user and are configured to send the registered data to the portable radio communication device, when triggered by the safety device, the attachment device or when an instruction is received from the portable radio communication device.

The siren device is configured to sound an alarm when triggered by the safety device, the attachment device or an instruction received from the portable radio communication device.

Figure 3:
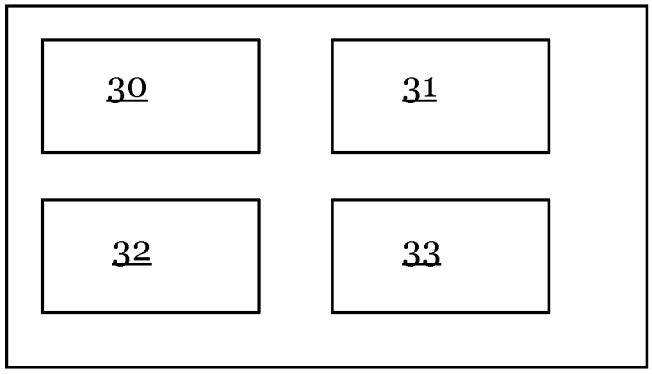
FIG. 3 is a schematic diagram illustrating functional modules of a security system presented herein.

FIG. 3 is a schematic diagram showing functional blocks of the security system. The modules may be implemented as only software instructions such as a computer program executing in first or second unit or only hardware, such as application specific integrated circuits, field programmable gate arrays, discrete logical components, transceivers, etc. or as a combination thereof. In an alternative embodiment, some of the functional blocks may be implemented by software and other by hardware. The modules correspond to the steps in the method illustrated in FIG. 2, comprising a detect manager 30, a record manager 31, a produce manager 32, and a send manager 33. In the embodiments where one or more of the modules are implemented by a computer program, then it shall be understood that these modules do not have to correspond to programming modules, but can be written as instructions according to the programming language in which they would be implemented, since some programming languages do not typically contain programming modules.

The detect manager 30 is configured to detect triggering of an alarm. This module corresponds to the detect step 10 of FIG. 2. This module can e.g. be implemented by a processor, when running a computer program.

The record manager 31 is configured to detect record voice data and/or image data surrounding the user. This module corresponds to the register step 11 of FIG. 2, and also the previous registration of audio. This module can e.g. be implemented by a processor, when running a computer program.

The produce manager 32 is configured to sound an alarm. This module corresponds to the alarm step 12 of FIG. 2. This module can e.g. be implemented by a processor, when running a computer program.

The send manager 33 is configured to send an alarm message to a network of recipients. This module corresponds to the send step 13 of FIG. 2. This module can e.g. be implemented by a processor, when running a computer program.

The security system may thus have a first unit with built-in camera, voice recognizer, GPS navigation and siren. The first unit may communicate with a user's own mobile that also may record audio and GPS. If an attacker would have time to throw away the camera part module, i.e. the first unit, the mobile also capture voice and may capture geographical position for some time before help arrives. The security system acts when you need help.

With a simple voice code, e.g. "help", you may trigger the alarm which immediately registers audio and may take pictures and video records the situation and forthwith transmit them to the network of recipients. An alarm may be sent with a built-in code that can provide all information about the emergency, voice recording, image capture, and a positioning data with address of an alarm text that is sent. When a receiver of an alarm message is a personal connection, that person may take personal action or may contact a general emergency central.

Both people in the network and security guards can act in real time. All information is preferably archived in a central unit in the network. The security system may have a safety latch mounted, and an activation/deactivation code may be wrapped, or a particular voice code may be used, before the first unit is turned off so that no attacker can remove the first unit without the alarm goes off. An alarm message preferably goes away regardless of if the first unit is deactivated unintentionally by the user or intentionally by an attacker. The alarm message will at least include an audio recording of the surrounding of the user. The attacker will be documented and all will be archived even if the attacker would destroy the visible first unit. The first unit works with the mobile, i.e. the second unit, and although an attacker may have time to make an assault, it minimizes the risk when a loud alarm also goes off from the first unit and possibly also from the mobile.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A security system for personal protection, comprising a first unit and a second unit separate from the first unit, wherein the first unit comprises a camera device, a microphone device, a siren device, a safety device, an attachment device, and a communication device for communication wirelessly with the second unit;

the second unit comprises a microphone device and a communication device for communication wirelessly with the first unit, the second unit further comprises a communication device for wirelessly sending an alarm message to a network of one or more recipients; and a third unit, separate from the first unit and separate from the second unit, the third unit comprising a positioning device and a communication device, wherein the third unit is configured to activate the positioning device and send a geographical position to the network after activation from the first or the second unit; wherein the security system is configured to, when triggered to send an alarm message, activate the microphone device of the first unit and the microphone device of the second unit, such that the alarm message contains an audio recording from the first unit and the second unit from an environment of a user of the security system.

2. The security system according to claim 1, wherein the first unit is during use attached to a user through the attachment device, and the second unit is during use carried by that user.

3. The security system according to claim 1, wherein the second unit is a portable radio communication device and the first unit is an auxiliary device to the portable radio communication device.

4. The security system according to claim 1, wherein the first unit comprises at least one of a positioning device or a warning light.

5. The security system according to claim 4, wherein at least one of the first unit or the second unit comprises a positioning device.

6. The security system according to claim 1, wherein the security system is activated/deactivated through a user-verification on the second unit.

7. The security system according to claim 1, wherein the safety device comprises a proximity sensor, for detecting the distance to the second unit, a switch sensor for detecting when the attachment device is being opened, or a contact sensor for detecting removal from a manipulation device.

8. A security system for personal protection, comprising a first unit, a second unit separate from the first unit, and a third unit separate from the first unit and separate from the second unit, wherein the first unit comprises attachment means for attachment of the first unit on a user during use of the security system, registration means for registration of surroundings of the user, alarm means for sounding a siren, and communication means for communication wirelessly with the second unit;

the second unit comprises registration means for registration of surroundings of the user and communication means for communication wirelessly with the first unit, the second unit further comprises communication means for wirelessly sending alarm messages to a network of one or more recipients;

the third unit comprising a positioning device and a communication device, wherein the third unit is configured to activate the positioning device and send a geographical position to the network after activation from the first or the second unit; and the communication means of the second unit is configured to send an alarm message to the network when one or more of the following occurs: the first or second unit is manipulated, when a voice command is registered through the registration means of the first unit or of the second unit, and when an actuator is triggered; wherein the security system is configured to, when triggered to send an alarm message, activate a microphone of the first unit and a microphone of the second unit, such that the alarm message contains an audio recording from the first unit and the second unit from an environment of a user of the security system.

9. A method for personal protection comprising the steps in the following order:

recording audio in a first unit and in a second unit separate from the first unit, detecting manipulation in the first unit wirelessly connected to the second unit, or detecting a voice command in the first unit or in the second unit;

recording video and audio in the first unit and audio in the second unit;

producing an alarm signal in the first unit;

activating a positioning device in a third unit separate from the first unit and separate from the second unit, where activating the positioning device sends a geographical position to the network after activation from the first or the second unit; and sending a message to a network of one or more recipients from the second unit, wherein the message includes audio recordings of the first unit and of the second unit.

10. The method according to claim 9, further comprising the step of producing an alarm signal in the second unit.

* * * * *